US008188882B2

(12) United States Patent
Mathiszik

(10) Patent No.: US 8,188,882 B2
(45) Date of Patent: May 29, 2012

(54) DEPTH MEASUREMENT BY DISTRIBUTED SENSORS

(75) Inventor: Holger Mathiszik, Eicklingen (DE)

(73) Assignee: Baker Hughes Incorporated, Houston, TX (US)

( * ) Notice: Subject to any disclaimer, the term of this patent is extended or adjusted under 35 U.S.C. 154(b) by 1086 days.

(21) Appl. No.: 12/099,505

(22) Filed: Apr. 8, 2008

(65) Prior Publication Data

US 2008/0252479 A1 Oct. 16, 2008

Related U.S. Application Data

(60) Provisional application No. 60/912,055, filed on Apr. 16, 2007.

(51) Int. Cl.
*G01V 3/00* (2006.01)

(52) U.S. Cl. ..... 340/856.3; 175/45

(58) Field of Classification Search ..... 340/856.3; 175/40, 45; 702/9; 73/152.46
See application file for complete search history.

(56) References Cited

U.S. PATENT DOCUMENTS

| | | | | |
|---|---|---|---|---|
| 5,193,628 | A | 3/1993 | Hill, III et al. | |
| 7,114,580 | B1 | 10/2006 | Balogh | |
| 7,555,391 | B2 * | 6/2009 | Gleitman | 702/9 |
| 7,962,288 | B2 * | 6/2011 | Gleitman | 702/9 |
| 2005/0206498 | A1 * | 9/2005 | Tsui et al. | 340/5.71 |
| 2009/0260876 | A1 * | 10/2009 | Gleitman | 175/24 |
| 2010/0139981 | A1 * | 6/2010 | Meister et al. | 175/61 |

OTHER PUBLICATIONS

PCT Search Report and Written Opinion PCT/US2008/060223; International Search Report 6 Pages and Written Opinion 6 Pages.

* cited by examiner

*Primary Examiner* — William P Neuder
(74) *Attorney, Agent, or Firm* — Cantor Colburn LLP

(57) ABSTRACT

A downhole device, position verifiable string includes a downhole device; a string in operable communication with downhole device; and a plurality of sensor units each sensing at least one of acceleration and strain in the string and spaced from each other along the string from downhole device to a remote location of the drill string and method.

12 Claims, 2 Drawing Sheets

DEPTH MEASUREMENT BY DISTRIBUTED SENSORS

CROSS REFERENCE TO RELATED APPLICATIONS

This application claims the benefit of an earlier filing date from U.S. Provisional Application Ser. No. 60/912,055 filed Apr. 16, 2007, the entire disclosure of which is incorporated herein by reference.

BACKGROUND OF THE INVENTION

In the hydrocarbon recovery industry, information about particular conditions in the downhole environment has become one of the most important currencies of the day. Sensors are being used to monitor downhole temperature and pressure conditions as well as chemical composition, and used for seismic formation evaluation, etc. While sensors work very well for their intended usage, they have been heretofore utilized virtually entirely for discrete downhole tools for discrete downhole regions. Even in the case of distributed temperature sensors, suggesting a wider placement, they are directed to a zone or a plurality of zones but in only a relatively small percentage of the well.

In view of the fervor regarding additional information about well conditions, and the success that the art has had with sensors for discrete uses, the art will well receive new configurations providing additional information.

SUMMARY

A downhole device, position verifiable string is disclosed herein. The string includes a downhole device; a string in operable communication with downhole device; and a plurality of sensor units each sensing at least one of acceleration and strain in the string and spaced from each other along the string from downhole device to a remote location of the drill string.

A method for measuring position of a downhole device on a string is disclosed herein. The method includes monitoring a plurality of sensor units for at least one of acceleration and strain, the sensor units being positioned in spaced relationship to one another from the downhole device to a surface location of the string; calculating an actual location of each sensor unit; and determining an actual location of the downhole device.

BRIEF DESCRIPTION OF THE DRAWINGS

Referring now to the drawings wherein like elements are numbered alike in the several Figures.

DETAILED DESCRIPTION OF THE DRAWINGS

Heretofore, there has been no recognition of the use of sensors distributed over a distance, each sensing local properties but for the purpose of collectively monitoring something otherwise not reliably predictable.

Figure 1:
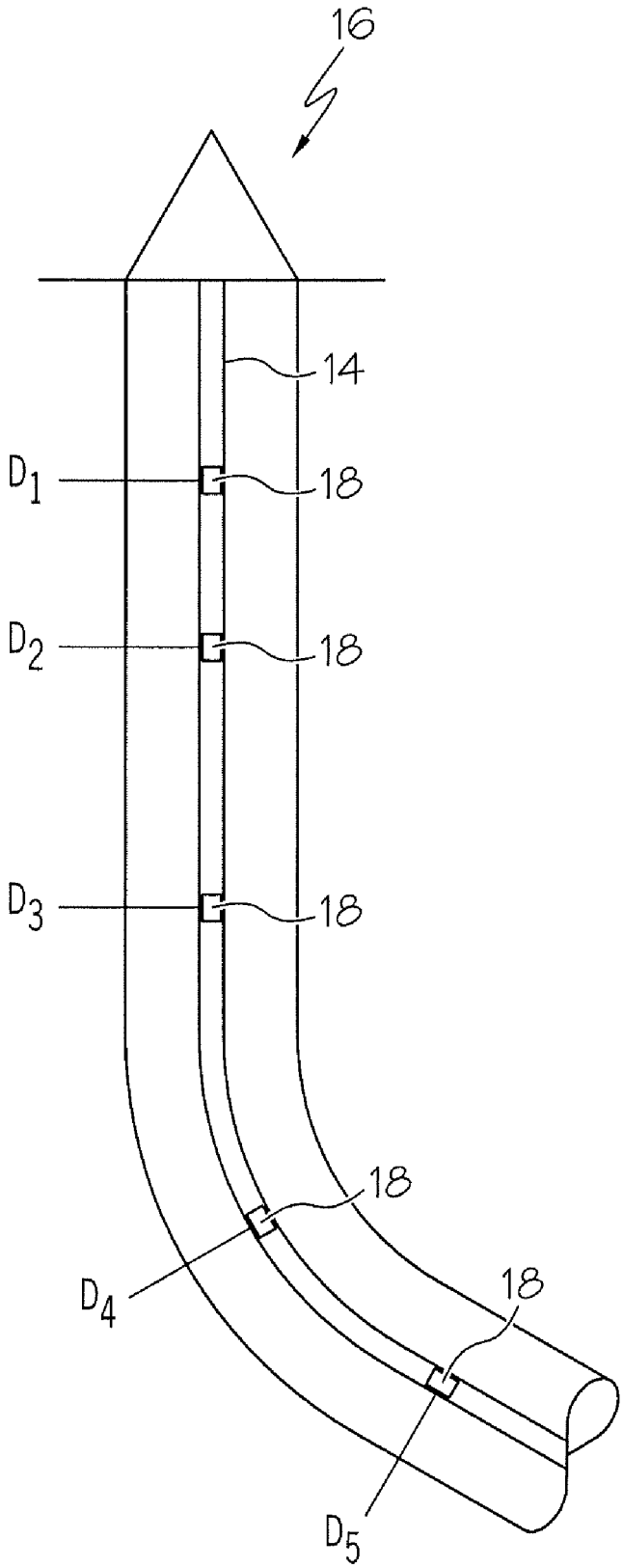
FIG. 1 is a schematic view of a well system having a drill string therein with distributed sensors thereon.

Referring to FIG. 1, a wellbore 10 is illustrated in a formation 12. Within the wellbore 10 is a string such as a drill string 14 extending from a surface location 16 to depth. It is to be understood that a bottom hole assembly is envisioned at a downhole end of the drill string 14 though such is not shown as it is intended that the bottom hole assembly would be at a significant distance from the surface location 16. One of ordinary skill in the art is familiar with a bottom hole assembly and its location relative to a drill string and therefore it is not necessary that it be specifically pointed out. Disposed upon the drill string 14 is a plurality of sensor units 18 spaced from one another and that in one embodiment are substantially equidistantly spaced along the drill string 14. Each sensor unit 18 may be a single sensor or may be a collection of sensors at a particular location or may be a multi-function sensor in a single package, as desired, and as is efficient, with a particular application. It is to be appreciated that while the sensor units 18 are all illustrated at one side of the drill string it is possible and contemplated that the sensor units may be disposed about the drill string on either side, helically, etc. It is further to be appreciated that the more sensor units that are placed along the drill string 14, the better with respect to accuracy of the ultimate measurement. Because the number of sensor units is otherwise limited by cost or available real estate, however, it will often be the case that fewer sensor units will be used. In one example, sensor units are placed about 30 m apart whereas in another example sensor units are placed about 600 m apart. Different measurements both greater than and less than the two examples are also possible. A high-speed bus is utilized to connect the sensor units. In some cases this will be to a remote control location, such as the surface, while in other cases it may be to another more proximate location. The high-speed bus connection allows for real-time information to be utilized from the remote location in order to take corrective actions or to take advantage of opportunities identified by the sensor units.

Figure 2:
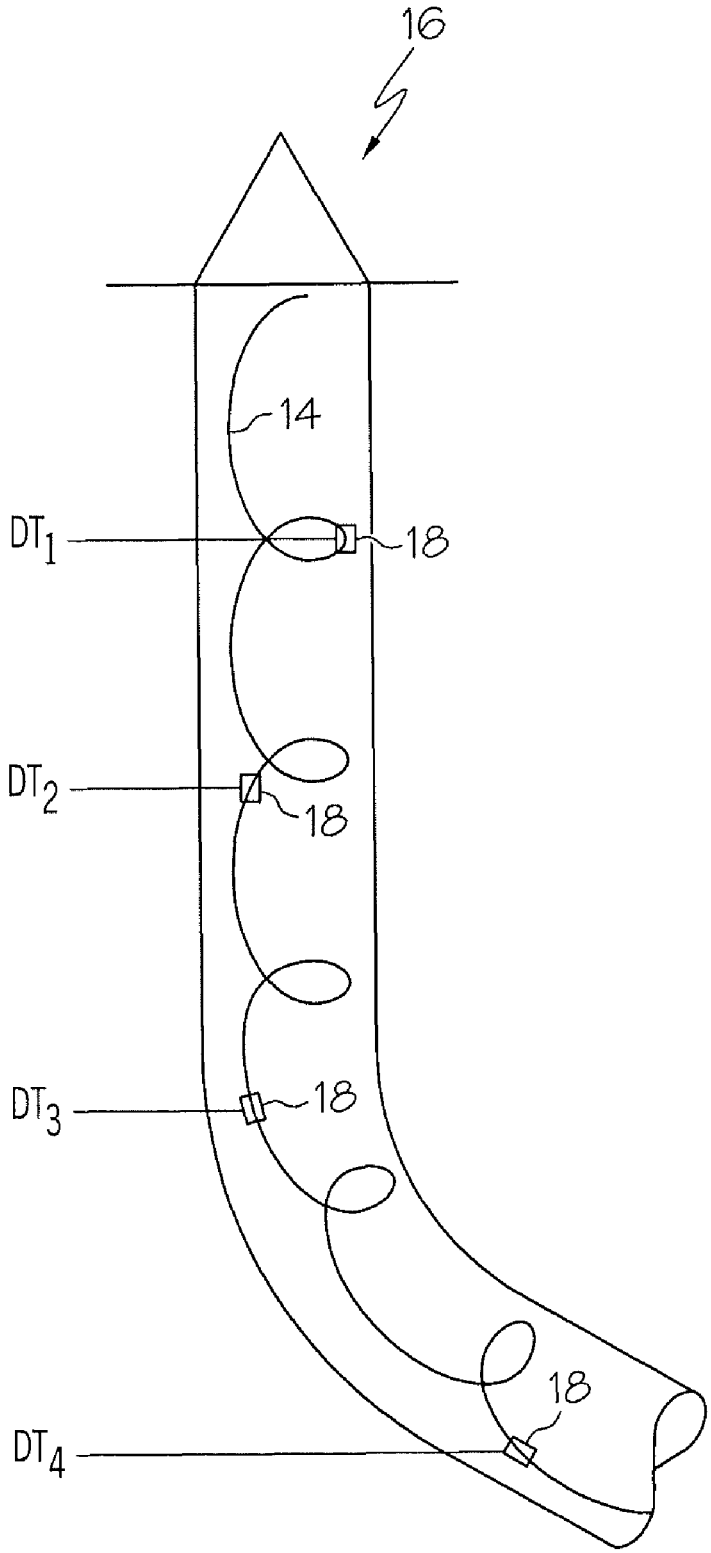
FIG. 2 is another schematic view similar to that of FIG. 1 but graphically indicating some of the torsional forces experienced by the drill string.

The sensor units utilized in the present invention include, without limitation, accelerometers and strain gauges whether digital, analog or optical and are utilized to determine the specific position of each sensor unit in the wellbore. A plurality of the sensor units are used together to determine the position of a specific target or device within the wellbore. The plurality of sensor units may be all of the sensor units or may be a subset of all of the sensor units, as desired. The greater the number of sensor units utilized to determine the position of the target device the greater the accuracy of that position determination. More specifically, an accelerometer is capable of tracking its accelerations by magnitude and direction; the strain gauges are capable of measuring strain in the drill string itself caused by at least one of torsional, tensile, and compressive stress (see FIG. 2 where the drill string 14 is depicted schematically as wound up and indicating different possible locations for sensor units relative to particular loci of winding). In either case the information is transmitted to the remote control location for computational procedures.

Measuring strain in the drill string over a distributed sensor system allows one to calculate and accurate condition of the string in view of all of the stressors it sees. These include bending moments, compression, torsion, tension, etc. through measurement of these stressors, it is possible to actually determine an accurate location of the bottom hole assembly of the drill string in real time. Drill strings, when run into the earth, experience many stressors including those indicated above. These stressors and additional influences such as temperature (thermal expansion of material) and even surface based physical measurement errors with respect to actual length of each segment of pipe cause changes in the length and azimuth of individual pieces of the drill string. Collectively, all of the pieces (e.g. pipe joints) having relatively minor changes in their dimensions will produce, in aggregate, a large change in anticipated position (length and/or azimuth)

of a target device such as one of the sensor units or other device in the hole or the bottom hole assembly of the drill string, for example. The effect is amplified with the length of the drill string and it would not be surprising for one to incorrectly assume, based upon an expectation of depth relying only upon the length of individual segments of drill string pipe, that a bottom hole assembly might be 30 feet or more from where it actually is. The error could be in pure vertical depth or in deviated location from a vertical reference for both. Clearly, error of such a magnitude is undesirable. This is particularly true in modern wells where multilateral legs are utilized to access smaller and disparately located formation reservoirs. For example, it may be that a particular reservoir is only 100 feet thick, but very wide and therefore containing a substantial amount of recoverable hydrocarbons. In such a thin reservoir, having an actual bottom hole assembly location that is more than 30 feet from where it was expected to be can mean the difference between a successful recovery operation and an unsuccessful recovery operation. For this reason alone, it is certainly desirable to have accurate real-time bottom hole assembly location information.

Because the problem of a mismatch of anticipated bottom hole assembly location and actual bottom hole assembly location is a significant concern, and there currently is no reliable method to obtain accurate depth and positional information about the bottom hole assembly, the art will be significantly benefited by adoption and use of the teaching herein.

As was noted above, changes in the drill string are cumulative over the length thereof. For example, in order to make the bottom hole assembly rotate, torque must be applied to the drill string at the surface. That torque is absorbed torsionally in the drill string for a period of time until enough "wind up" in the drill string allows the torque applied from the surface to act on the bottom hole assembly. Such torsional "wind up" in the drill string causes the string to become shorter and can be measured to determine the degree of shortening. The amount of wind up, and therefore shortening, in particular sections of the drill string is different depending upon the proximity or distance of that particular section from the locus of torque application. Multiple sensor units placed along the length of the drill string and correlated with modeled information about the amount of shortening as it relates to the amount of torsional stress provides accurate and calculated information about overall length of the drill string. The Modeling concept as contemplated will be substantially similar to that disclosed in IADC/SPE 59235 entitled Lateral Drillstring Vibrations in Extended Reach Wells by G. Heisig, SPE, Baker Hughes Inteq, M. Neubert, SPE, Baker Hughes Inteq GmbH published February 2000 and incorporated herein by reference in its entirety, but will be utilized differently to provide depth indication. Determination of depth has never heretofore been modeled in this way nor has the type of information being gathered, as taught herein, been employed for depth measurement. In addition to the shortening of the drill string, there are also changes in the acceleration of particular parts of the drill string due to the applied torque and again the proximity or distance from the location of application of that torque. These properties are both a cause of mismatches in the anticipated versus the actual bottom hole assembly position (or other target device position) and are beneficially usable through the distributed sensor arrangement taught in herein to mathematically determine the actual bottom hole position in real time. In order to realize the benefits associated with this teaching as indicated above, a plurality of distributed sensors or sensor units is required. Such sensor units will extend substantially from the bottom hole assembly to the surface in regular increments of space. The more sensor units, the greater the accuracy of the system. The greater accuracy is because discrete sections of the overall drill string will have differing levels of strain. The more discrete the sections of string that are measured by the sensor units in the system, the greater the accuracy and mathematical calculation of actual depth and position the bottom hole assembly. The position of each one of the sensor units is modelable (by a method similar to that described in the SPE article incorporated hereinabove based upon the strain and/or acceleration sensed by the sensor units. Therefore, a very accurate representation of the drill string position and attitude within the borehole is knowable in real time. It is to be understood that monitoring of the sensor units may be either continuous or intermittent, as desired.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole device position verifiable string comprising:

a downhole device in the string;

a string in operable communication with the downhole device; and a plurality of sensor units at least one of which sensing at least one of acceleration and strain in the string and at least one of which sensing the other of at least one of acceleration and strain in the string, the plurality of sensor units being spaced from each other along the string from the downhole device to a remote location of the string, the at least one sensor sensing acceleration and the at least one sensor sensing strain being operative together to measure conditions of the string to determine length and/or azithmul properties of one or more individual pieces of the string to verify a position of the device.

2. The downhole device position verifiable string as claimed in claim 1 wherein the string further includes a high-speed bus system interconnecting each of the plurality of sensor units.

3. The downhole device position verifiable string as claimed in claim 1 wherein at least one of the plurality of sensor units is digital.

4. The downhole device position verifiable string as claimed in claim 1 wherein at least one of the plurality of sensor units is analog.

5. The downhole device position verifiable string as claimed in claim 1 wherein at least one of the plurality of sensor units is optical.

6. The downhole device position verifiable string as claimed in claim 1 wherein the device is a bottom hole assembly.

7. A method for measuring position of a downhole device on a string comprising:

monitoring a plurality of sensor units for at least one of acceleration and strain wherein at least one of the plurality of sensor units senses at least one of acceleration and strain in the string and at least one other of the plurality of sensor units senses the other of at least one of acceleration and strain in the string, the acceleration and strain sensor units being positioned in spaced relationship to one another from the downhole device to a surface location of the string and operative together to provide length and/or azithmul properties of one or more individual pieces of the string;

calculating an actual location of each sensor unit; and determining an actual location of the downhole device.

8. The method as claimed in claim 7 wherein the calculating includes inserting data obtained from the monitoring into a computer model.

9. The method as claimed in claim 7 wherein the monitoring is intermittent.

10. The method as claimed in claim 7 wherein the determining results in a characterization of depth.

11. The method as claimed in claim 7 wherein the determining results in a characterization of azimuth.

12. An arrangement to determine location in real time comprising:

a string; and a plurality of sensor units disposed along an entire length of the string, at least one of which sensing at least one of acceleration and strain in the string and at least one of which sensing the other of at least one of acceleration and strain in the string and being relatively evenly spaced from each other along the string, the acceleration and strain sensors operative together to provide length and or azithmul properties of one or more individual pieces of the string such that actual position of a portion of the string is calculable in real time.

* * * * *